US007025612B1

(12) United States Patent
Keilholz et al.

(10) Patent No.: US 7,025,612 B1
(45) Date of Patent: Apr. 11, 2006

(54) BASE FOR A MOGUL-BASED LAMP

(75) Inventors: Michael J. Keilholz, Cincinnati, OH (US); Mark C. Reed, West Chester, OH (US); Robert E. Kaeser, Cincinnati, OH (US)

(73) Assignee: LSI Industries, Inc., Cincinnati, OH (US)

( * ) Notice: Subject to any disclaimer, the term of this patent is extended or adjusted under 35 U.S.C. 154(b) by 0 days.

(21) Appl. No.: 11/083,836

(22) Filed: Mar. 18, 2005

(51) Int. Cl.
*H01R 33/02* (2006.01)

(52) U.S. Cl. ..... 439/226; 429/230

(58) Field of Classification Search ..... 439/226, 439/182, 230
See application file for complete search history.

(56) References Cited

U.S. PATENT DOCUMENTS 3,107,134 A 10/1963 Kerrigan
3,248,685 A 4/1966 Knuppel
3,315,216 A 4/1967 Krupp et al.
4,382,654 A 5/1983 Schick
4,438,344 A * 3/1984 Albert et al. ..... 362/802
4,441,782 A 4/1984 Kneer
5,078,625 A * 1/1992 Anzai ..... 439/356
5,439,389 A 8/1995 Cheng et al.
5,446,336 A 8/1995 Gleixner et al.
5,474,467 A 12/1995 Chen
5,683,271 A 11/1997 Newman
5,698,935 A 12/1997 Newman
5,842,882 A * 12/1998 Sato et al. ..... 439/230
5,874,800 A 2/1999 Newman
5,967,847 A 10/1999 Newman
6,183,286 B1 * 2/2001 Hofmann ..... 439/336
6,494,730 B1 * 12/2002 Yan ..... 439/226
6,547,582 B1 * 4/2003 Matsuba et al. ..... 439/226
6,764,328 B1 * 7/2004 Van Dulmen et al. ..... 439/226
6,876,137 B1 * 4/2005 Wursching et al. ..... 439/230
6,913,491 B1 * 7/2005 Tansi et al. ..... 439/283

OTHER PUBLICATIONS

"Product Bulletin for Open Fixture Lampholders", Leviton Manufacturing Co., Inc., 2004.

* cited by examiner

*Primary Examiner*—Briggitte R. Hammond
(74) *Attorney, Agent, or Firm*—Daniel F. Nesbitt; Hasse & Nesbitt LLC

(57) ABSTRACT

A lampsocket having a porcelain body that has a base, a peripheral wall, and at least two of a rigid, longitudinal spacer projecting axially outwardly from the base. The longitudinal upper surfaces of the spacers engage opposite areas of the bottom of the base of the lamp. The lampsocket is intended for use with and to operate a class of lamps having a threaded base having an insulated extension from the central portion of the bottom of the lamp base, and a central button mounted on the insulated extension. The lampsocket can also accept, but can not make electrical contact with, other lamps that have a conventional base contact without the insulated extension.

13 Claims, 21 Drawing Sheets

BASE FOR A MOGUL-BASED LAMP

BACKGROUND OF THE INVENTION

The present invention pertains generally to lampholders for receiving electric lamps, and more particularly to a family of lampholders for use with mogul-based metal halide lamps that accept only lamps having a particular base structure while rejecting all others.

The earlier metal halide lamps include a relatively centrally located arc tube situated within the confines of an outer glass bulb. These arc tubes are conventionally made of quartz or ceramic, and operate at extremely high temperatures and relatively high pressures. Under certain undesirable conditions, a system failure or internal factors will result in a safety hazard being created, whereby a violent shattering of the arc tube will send hot glass and other lamp parts into contact with the bulb glass which, in turn, will break, releasing the hot glass and lamp parts into the surrounding environment. Under such conditions, there is an obvious risk of severe personal injury, fire and/or property damage.

For this reason, normally such earlier metal halide lamps are supported within what are referred to as "enclosed" fixtures whose structure is designed to contain violently released hot glass and other lamps parts. A lens cover is used in such fixtures. In addition, significant reductions in such potential violent failures can be achieved by relamping before the rated end of the life of the lamp. Another conventional manner in which such potential violent failures is reduced includes the user's periodically turning off the lamp to permit its cooling, so that upon relighting, a non-violent or less violent lamp failure is facilitated. As further referenced herein, these earlier metal halide lamps are referred to as an "enclosed-fixture lamp".

Recently, a new or later metal halide lamp has been developed that employs a relatively thick shroud of quartz or glass, and is situated intermediate the arc tube and the outer bulb glass such that, it the event of a violent lamp failure of the type described above, the shroud is intended to intercept and contain the hot glass and other lamp parts which would otherwise impact and possibly break the bulb glass. The intended result is a less expensive and equally safe lamp and fixture combination suitable for indoor commercial lighting applications such as offices and retail spaces, as well as other environments. Manufacturers of metal halide lamps are selling these later lamps for use in what are referred to as an "open" fixture, in which the lamp is mounted such that it is exposed during its use. As further referenced herein, these later metal halide lamps are referred to as an "open-fixture lamp".

One particular design for the open-fixture lamp comprises a lamp having a threaded base, characterized by having an insulated extension extending from the central portion of the bottom of the lamp base, with the central contact button mounted on the distal end of the insulated extension. As further referenced herein, these metal halide lamps are referred to as an "insulated extension lamp".

There are various means known to prevent the use of insulated extension lamps in "open" light fixtures. One means is to require, or regulate, the construction of open fixtures that use a specially-designed base that will only operate with the later or open-fixture lamps, but will not operate with the earlier or enclosed-fixture lamps. The open-fixture lamp should be differently and uniquely designed to be identified as an open-fixture lamp socket by a person installing or maintaining the light fixture. U.S. Pat. No. 5,874,800 discloses a lampholder with a mogul base having a wall structure formed around the cantilevered contact and having a wall top that defines an aperture through which the insulated extension of the lamp can pass.

There remains a need to provide improved open-fixture lampholders for open-fixture lamps, which can be easily distinguished from the enclosed-fixture lampholders, and that prevent operation of enclosed-fixture lamps therein.

SUMMARY OF THE INVENTION

The present invention relates to a lampsocket for completing an electric circuit with a received lamp having a threaded base having an insulated extension from the central portion of the bottom of the lamp base, and a central button mounted on the insulated extension, comprising: a) a lampsocket body of insulating material comprising:

(1) a peripheral wall with an open end to form a cavity within the socket body, (2) a base at the closed second end, and (3) at least two of a longitudinal rigid insulating spacer projecting axially outwardly from the base, having an upper surface disposed to engage opposite areas of the bottom of the base of the received lamp, wherein the spacers are positioned on opposite sides of the center of the base, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

The present invention also relates to a lampsocket for completing an electric circuit with a received lamp having a threaded base having an insulated extension from the central portion of the bottom of the lamp base, and a central button mounted on the insulated extension, comprising: a) a lampsocket body of insulating material comprising: (1) a peripheral wall with an open end to form a cavity within the socket body, (2) a base at the closed second end, and (3) at least one rigid insulating spacer extending axially outwardly from the socket base, and having a proximate end associated with the peripheral wall, and a distal end projecting inwardly, and having an upper surface disposed to engage the bottom of the base of the received lamp, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

The invention also relates to a lampsocket for completing an electric circuit with a received lamp having a threaded base having an insulated extension from the central portion of the bottom of the lamp base, and a central button mounted on the insulated extension, comprising: a) a lampsocket body of insulating material comprising:

(1) a peripheral wall with an open end to form a cavity within the socket body, (2) a base at the closed second end, and (3) at least two of a rigid spacer, each extending axially outwardly from the base, and having an upper surface disposed to engage the bottom of the base of the received lamp, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

DETAILED DESCRIPTION OF THE INVENTION

The present invention provides an improved lampsocket that can accept and make electrical contact with the open-fixture lamps having and insulated extension contact, and can accept but not make electrical contact with the enclosed-fixture metal halide lamps having a conventional base contact.

Figure 22:
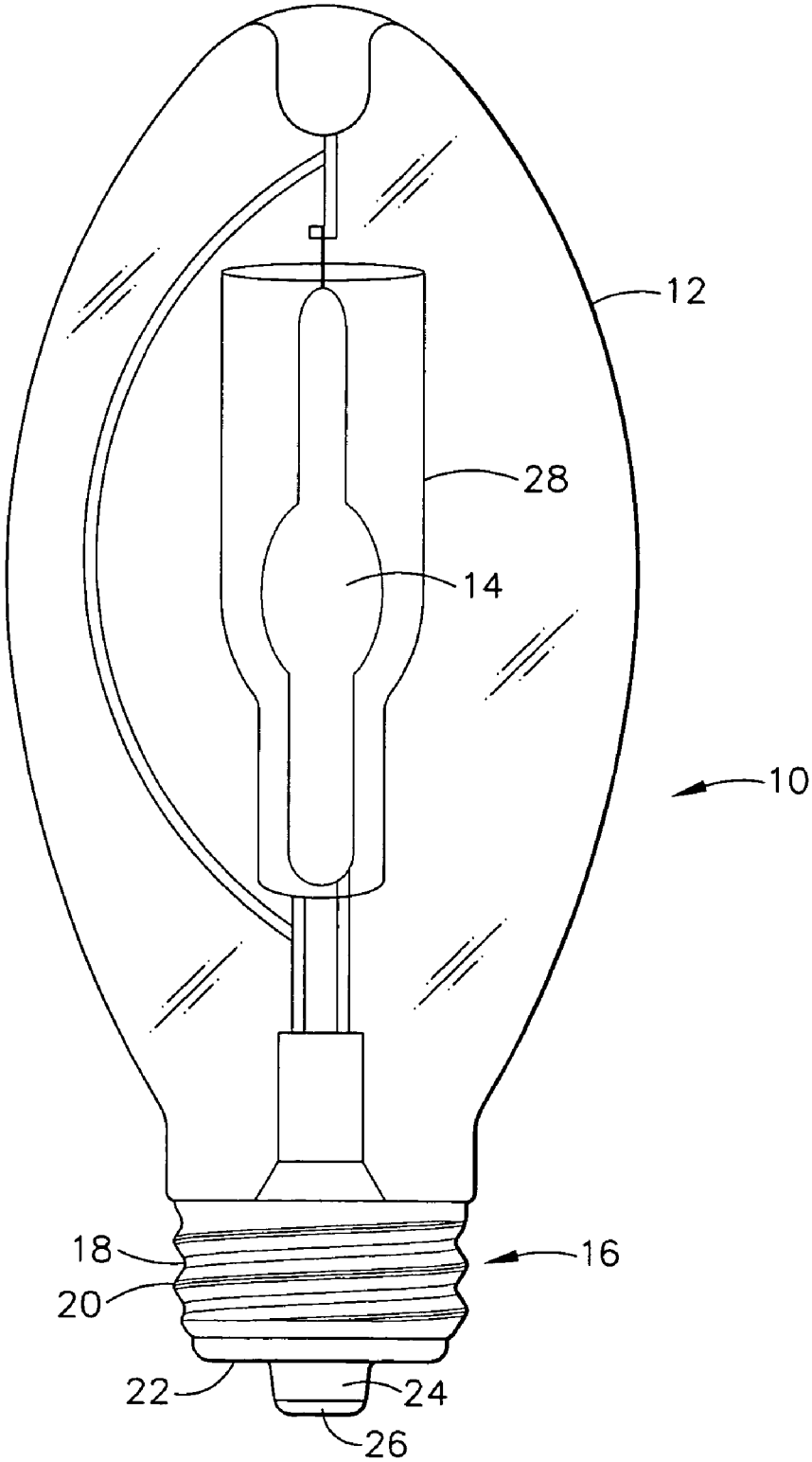
FIG. 22 (PRIOR ART)
FIG. 22 is an elevation view of lamp of the prior art having an insulated extension for use in the lampsocket of FIG. 1.

FIG. 22 shows a typical metal halide lamp 10, as part of the prior art, which can be used and operated in the lampsocket of the present invention. The lamp 10 has a glass bulb 12 within which is placed a quartz arc tube 14. A shroud 28 of thick quartz surrounds the arc tube 14 and isolates it from the outer bulb glass 12. Lamp 10 has a metal screw base 16 with a cylindrical side 18 having metal base threads 20, and a bottom flange 22. Any screw thread pattern can be chosen and the particular one shown is an American Standard mogul thread that is four threads per inch. The base 16 can be fabricated from any conductive metal such as copper or a copper alloy. The bottom flange 22 is typically made of an electrically insulating material. A relatively flat contact 26, often termed a solder or button, also made of a conductive metal, is joined to the end of an insulated extension 24, made of a non-conductive porcelain and extending from the flange 22 of the base 16. The base side 18 is electrically connected to one side of arc tube 14 while contact 26 is electrically connected to the other side.

Figure 1:
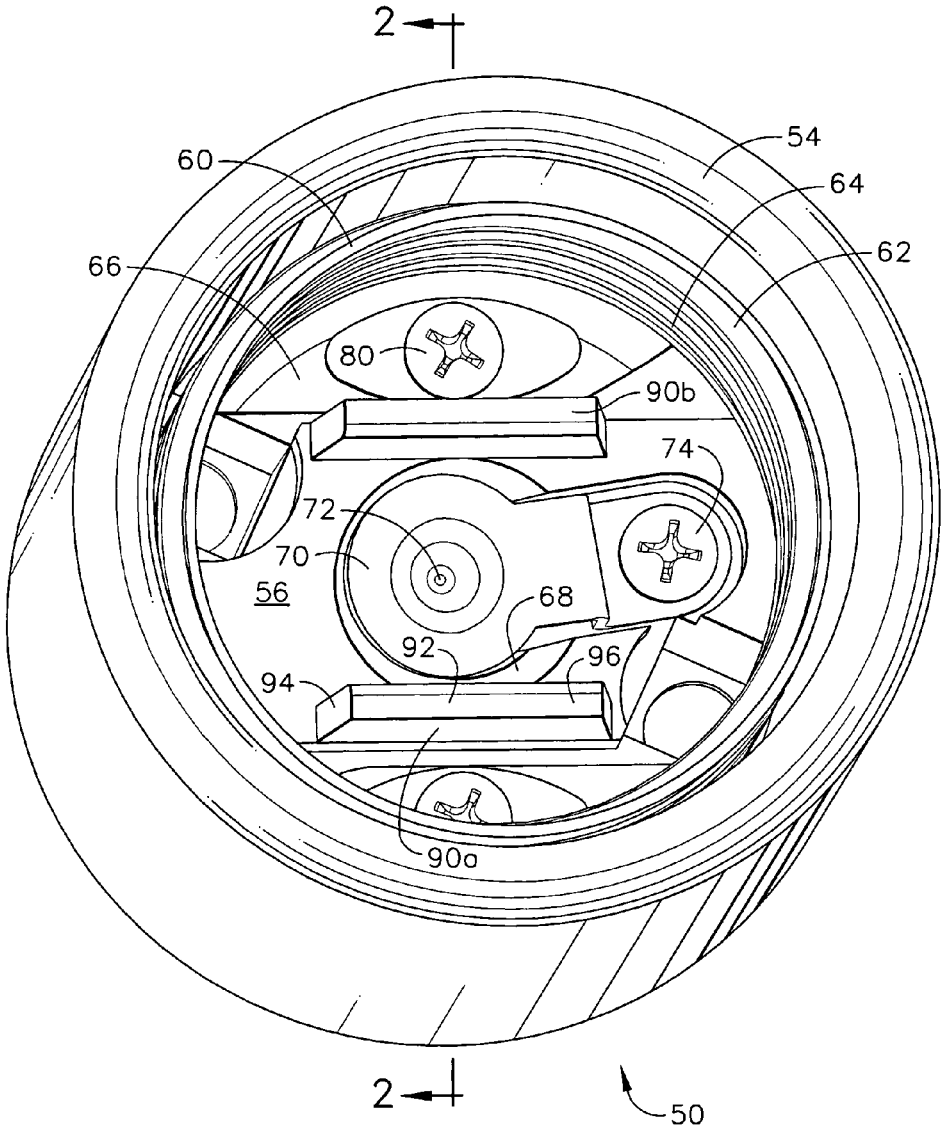
FIG. 1 is a perspective view of an embodiment of an open-fixture lampsocket of the present invention for use with a metal halide open-fixture lamp, having longitudinal insulating spacers.
Figure 2:
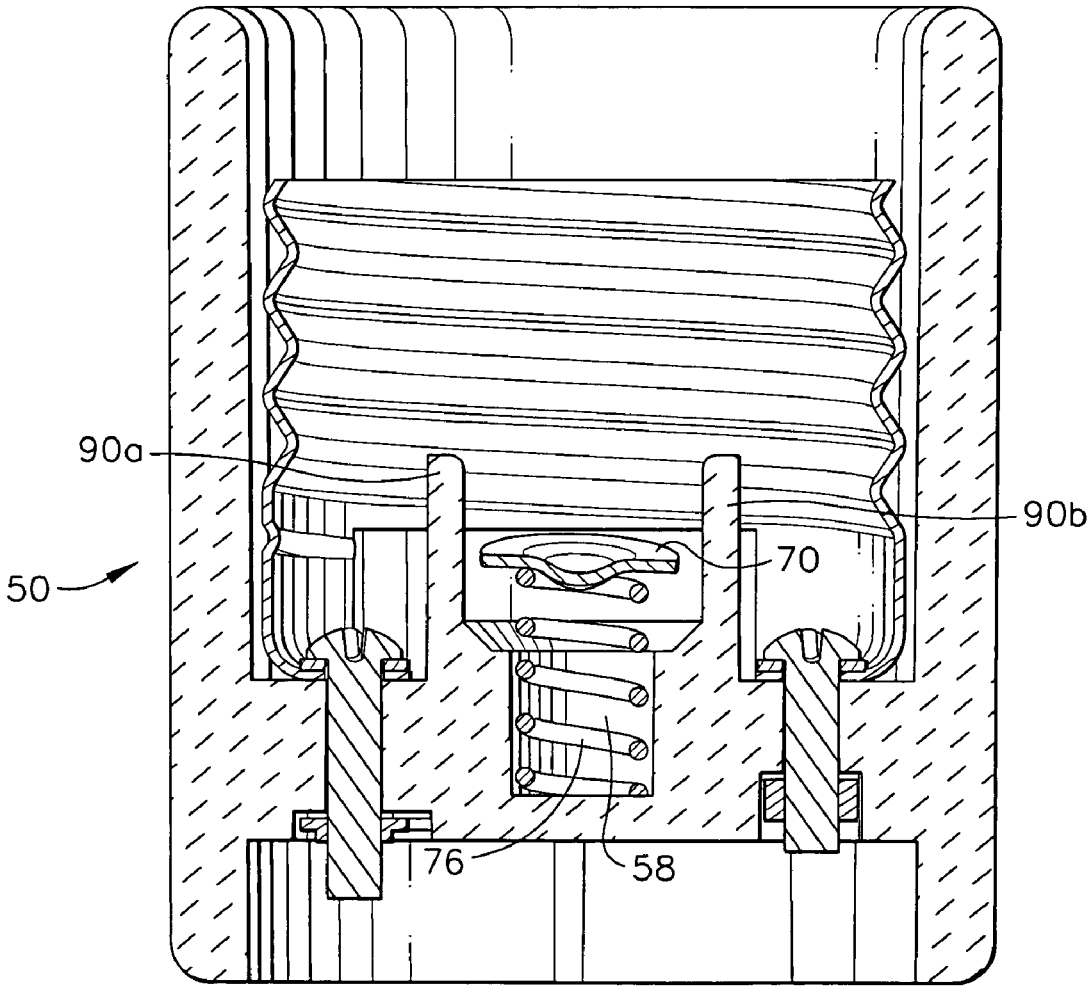
FIG. 2 is a cross-sectional view of the lampsocket of FIG. 1 through line 2—2.
Figure 3:
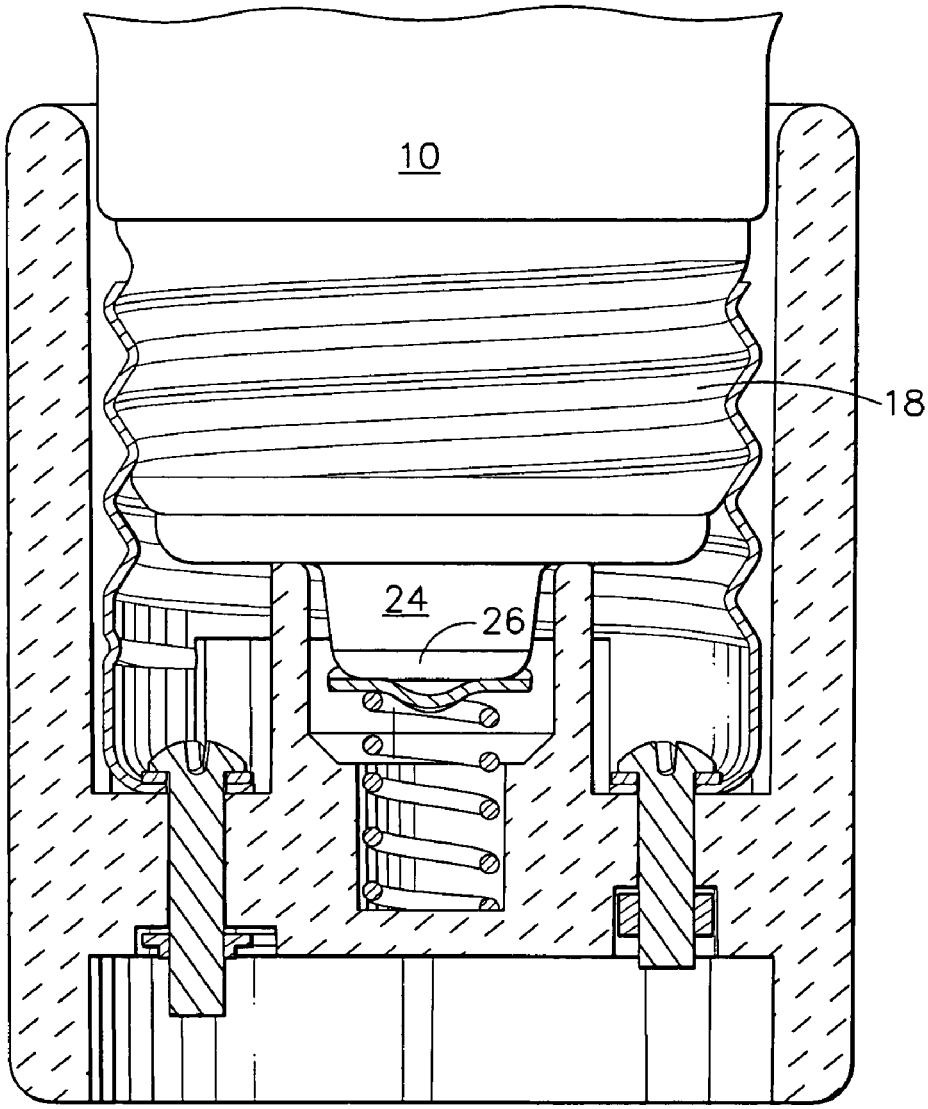
FIG. 3 is a perspective view of another embodiment of a lampsocket having longitudinal insulating spacers.

FIG. 1 shows a lampsocket 50 having a body 52 of insulating material such as rubber, plastic, porcelain, porcelain, or other suitable non-electrical conductive material. The lampsocket 50 surrounds a socket 60 having a metal sleeve 62 on which are formed threads 64 complementary to base threads 20 of lamp 10. The metal socket 60 is retained to the body of the lampsocket with a pair of retainers, shown as screws 80. A metal contact arm 70 is arranged to make contact with contact button 26 of lamp 10 and is electrically insulated from metal sleeve 62. Metal sleeve 62 is connected to one conductor of an AC supply (not shown) while contact arm 70 is connected to the second of such conductors of the AC supply (not shown) to provide current to operate lamp 10. The metal contact arm 70 is typically cantilever mounted to an electrically conductive post 74 at a first end, with a free distal end 72 substantially centered in the lampsocket with respect to the base 56. Typically, as shown in FIG. 2, a recess 58 is formed in the center of the base 56 to receive one end of a coil spring 76, the other end of which engages the underside of the contact arm 70 at distal end 72, to bias the metal contact arm 70 upwardly against contact 26 of lamp 10 when lamp 10 is inserted and received within the socket of the lampholder 50, as shown in FIG. 3.

The body 52 also comprises a pair of longitudinal rigid insulating spacers 90*a* and 90*b* extending upward from the base 56, outwardly into the internal cavity of the lampsocket 50. Each spacer 90 is made of a rigid, electrically insulating material, and has a top 92 that has a flattened surface that is substantially parallel with the base 56. Typically the spacers are made of the same material as the lampsocket body and are integral therewith. The tops 92 of the longitudinal spacers provide a generally planar contact surface against which the base portion of the lamp 10 engages when threaded into the lampsocket, as discussed herein after. The upright spacers 90*a* and 90*b* are oriented parallel to one another and are disposed on opposite sides of socket contact 70, to allow the extension 24 to pass there between and to maintain balanced support against the lamp base 16. The height to the spacers, from the base 56 to the top surface 92, is sized sufficient to prevent the contact button of a threaded conventional lamp, which does not have an insulated extension, from making contact with the contact arm 70. The height is typically extends above the distal end of the contact arm by at least about 2 mm, more typically about 4–6 mm.

The inside longitudinal side of the top surface of the spacer, which is proximate the center of the base, typically has a tapered or rounded edge.

The longitudinal ends of the spacers can be formed with a taper, extending toward the confluence of the base 56 and side wall 54. The longitudinal ends of the spacers can terminate typically inward of the metal sleeve 62. The edges of the spacers 90 and other features of the base 56 are typically rounded to avoid a linear edge that can more easily fracture and break away.

The lampsocket body 52 is typically made of a porcelain material by molding. The internal and external shapes and features of the body are formed of complementary shapes and features that have been formed into the body of a mold or pair of mating molds. To form the outwardly-projecting spacers 90, correspondingly configured grooves are carved or machined into the molds used to produce the lampsocket body. It can be understood that the machining of a longitudinal groove in the mold is more easily formed than that of a rounded or curved surface. The top surface 92 can optionally be coated with a hardened material such as an epoxy or glass that provides a smooth, hard surface that reduces frictional binding by the bottom flange 22 of the base 16 of the lamp with the top surface 92.

Lamp 10 can be threaded into socket 60 of lampholder 50 by rotating lamp 10 to advance lamp threads 20 along internal socket threads 64. Rotation of the lamp 10 can terminate when the flange 22 of the base 16 of the lamp engages the top 92 of the spacers 90, which limits further downward insertion of lamp 10. With the base 16 resting proximate the tops of the spacers 90, the insulated extension 24 projects the button contact 26 into engagement with the end 72 of socket contact 70. A good electrical contact between button 26 and end 72 is assured by the upwardly-biasing coil spring 76. The electrical contact completes the electrical circuit and supplies electrical current to lamp 10.

It can be understood that if an enclosed-fixture lamp is used in the lampsocket of the invention, the contacting of its base with the tops of the spacers 90 will prevent engagement and electrical communication of the socket contact 70 with the lamp contact button, since the earlier enclosed-fixture lamps do not have the insulated extension 24.

Figure 4:
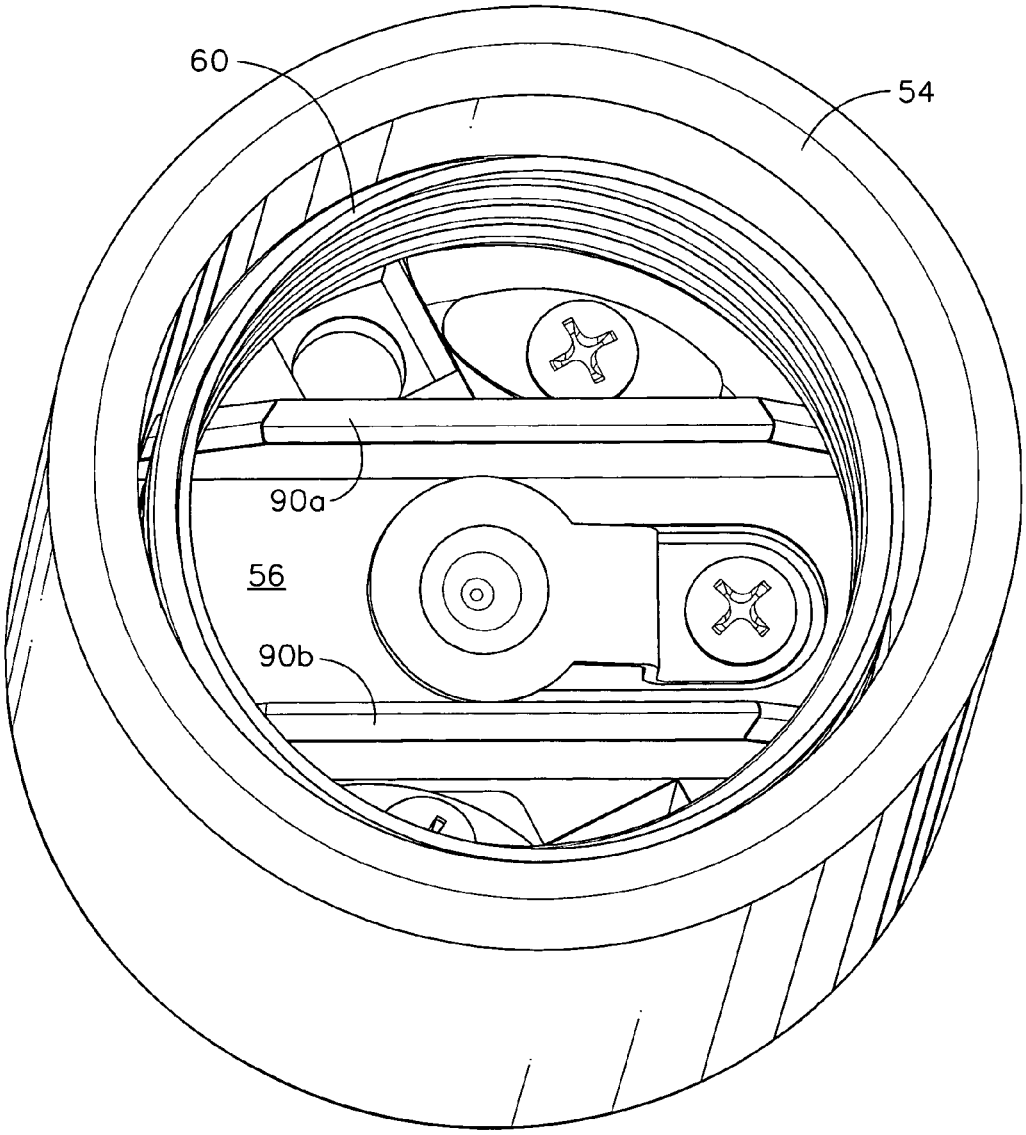
FIG. 4 is a perspective view of the lampsocket of FIG. 3 with a lamp inserted.
Figure 5:
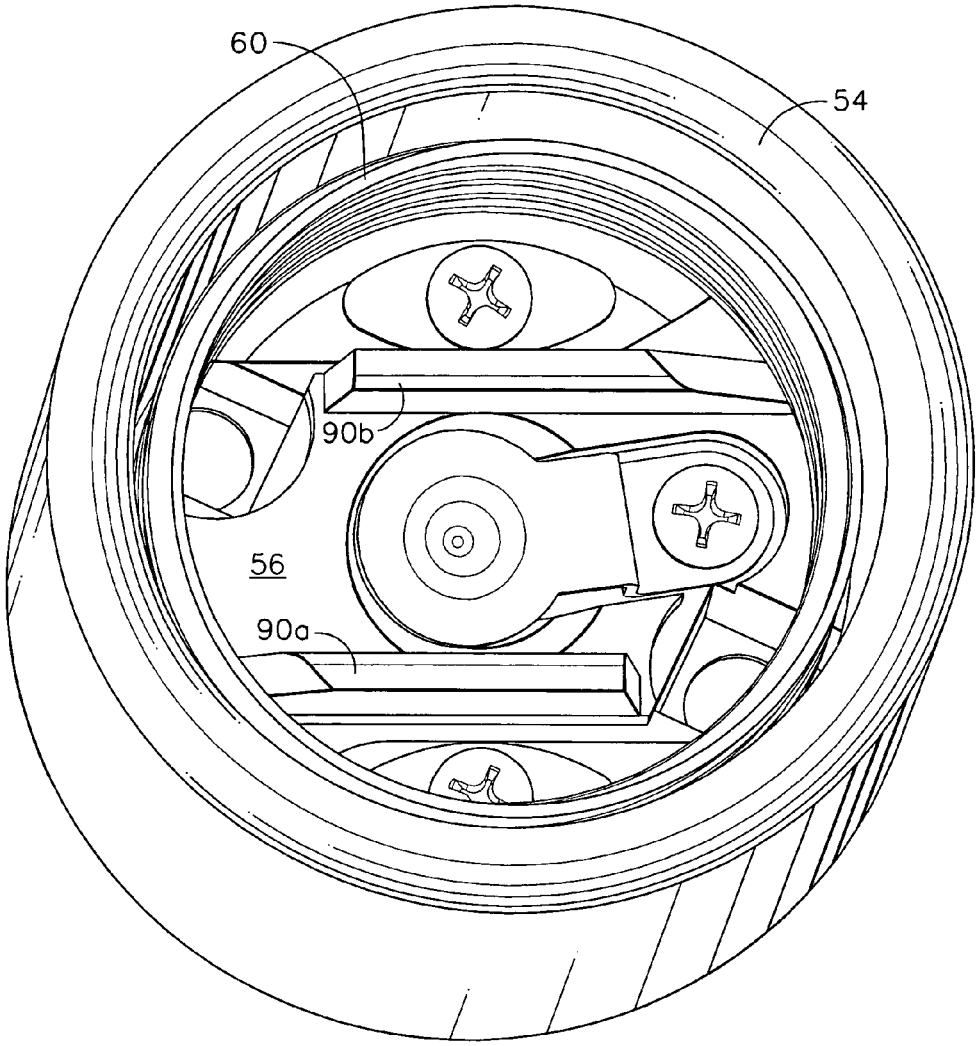
FIG. 5 is a perspective view of yet another embodiment of a lampsocket having longitudinal insulating spacers.

In an alternative embodiment of the present invention shown in FIG. 4, each distal end 94 and 96 of the longitudinal rigid insulating spacers 190*a* and 190*b* can extend to and associate with the peripheral wall 54 of the body. The association of the proximate ends 94 and 96 with the wall 54 can increase the integrity and strength of the longitudinal spacers 190 from being fractured or broken. Alternatively, an embodiment of the lamp socket can require that only one end of the longitudinal spacer needs to contact the side wall 54, as shown in FIG. 5.

Figure 6:
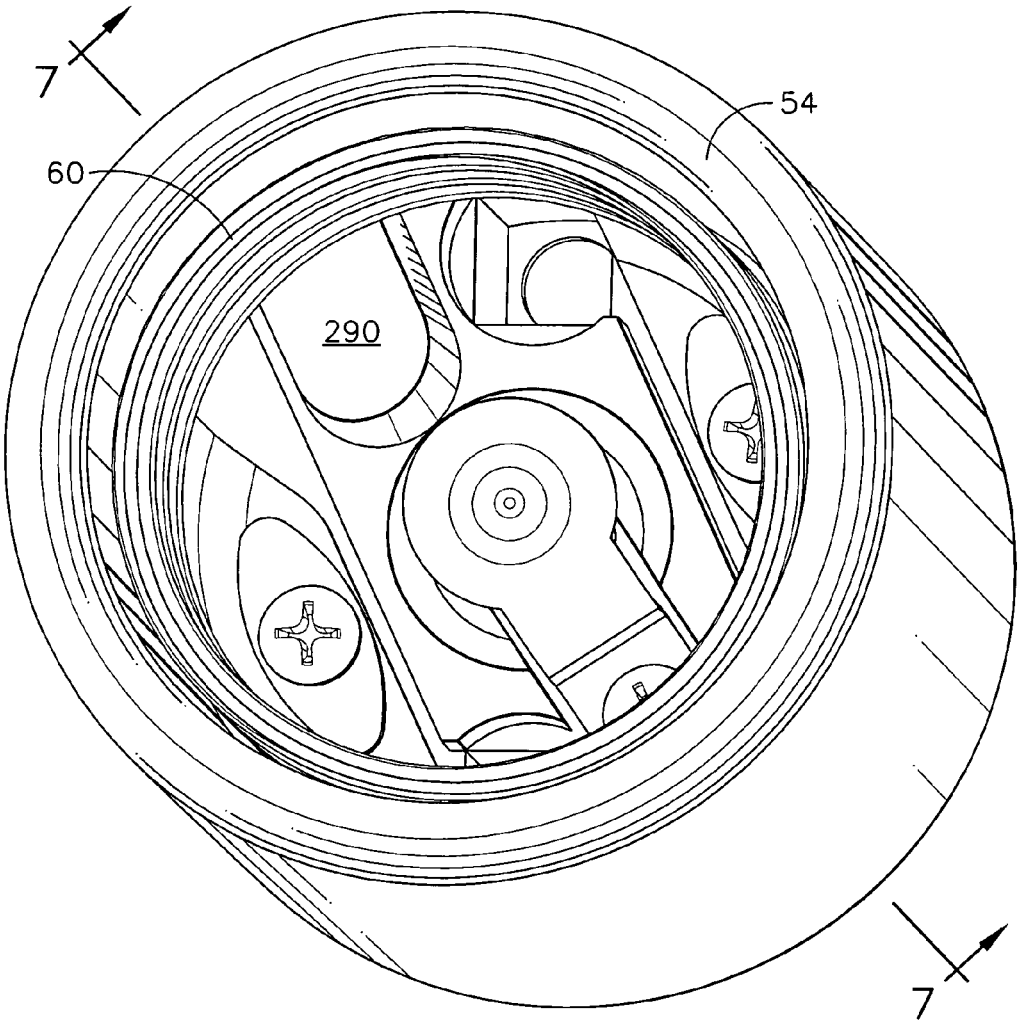
FIG. 6 is a perspective view of another embodiment of a lampsocket having an insulating spacer.
Figure 7:
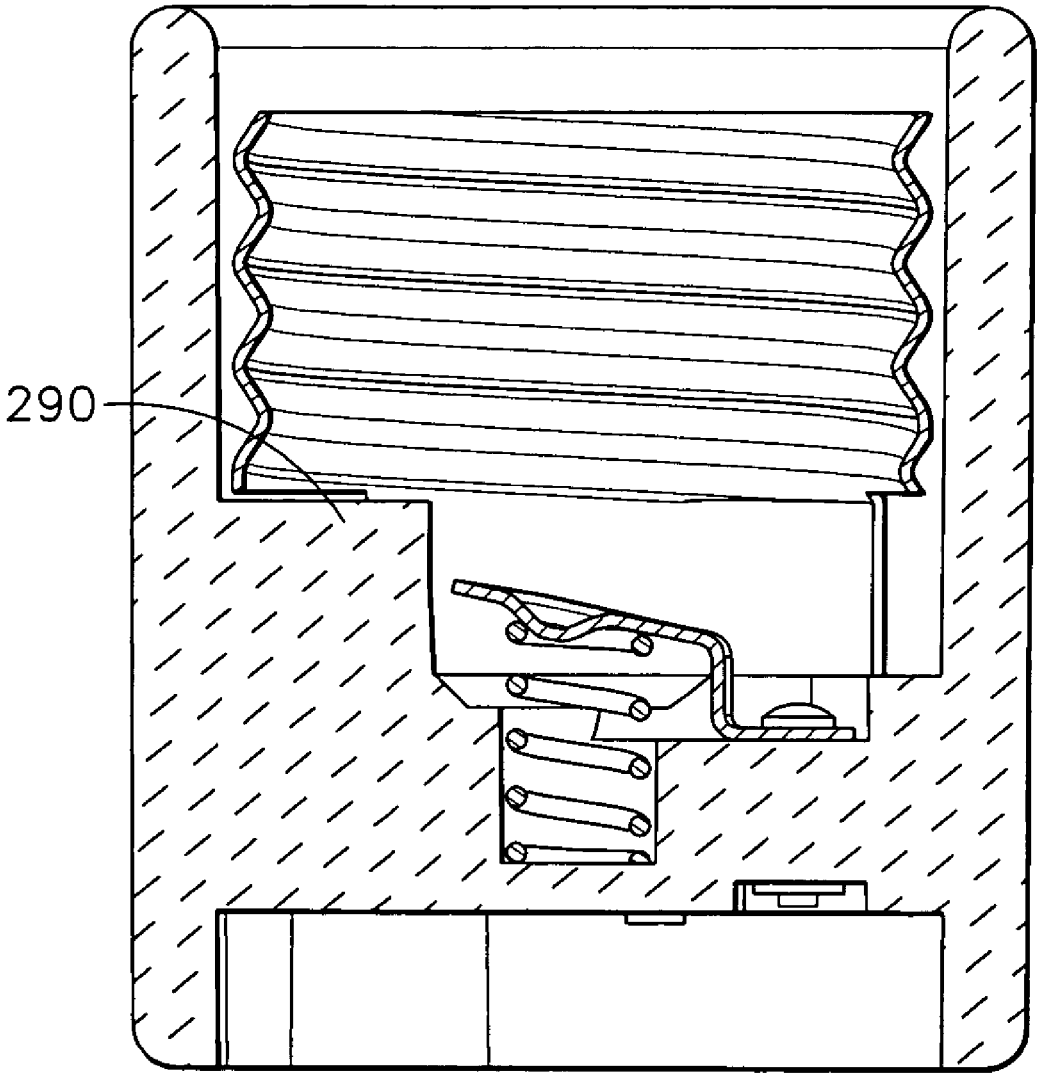
FIG. 7 is a cross-sectional view of the lampsocket of FIG. 5 through line 6—6.

In yet another alternative embodiment of the present invention, shown in FIGS. 6 and 7, the lampsocket can comprise a spacer 290 that extends axially outward from the socket base 56, and has a proximate end 94 associated with the peripheral wall 54 of the body, and a distal end 96 that projects inwardly toward or proximate the center of the base 56. The spacer is typically formed integrally with the base 56 and wall 54 of the body. The association of the proximate end 94 of the spacer 290 with the wall 54 can increase the integrity and strength of the member from being fractured or broken.

Figure 8:
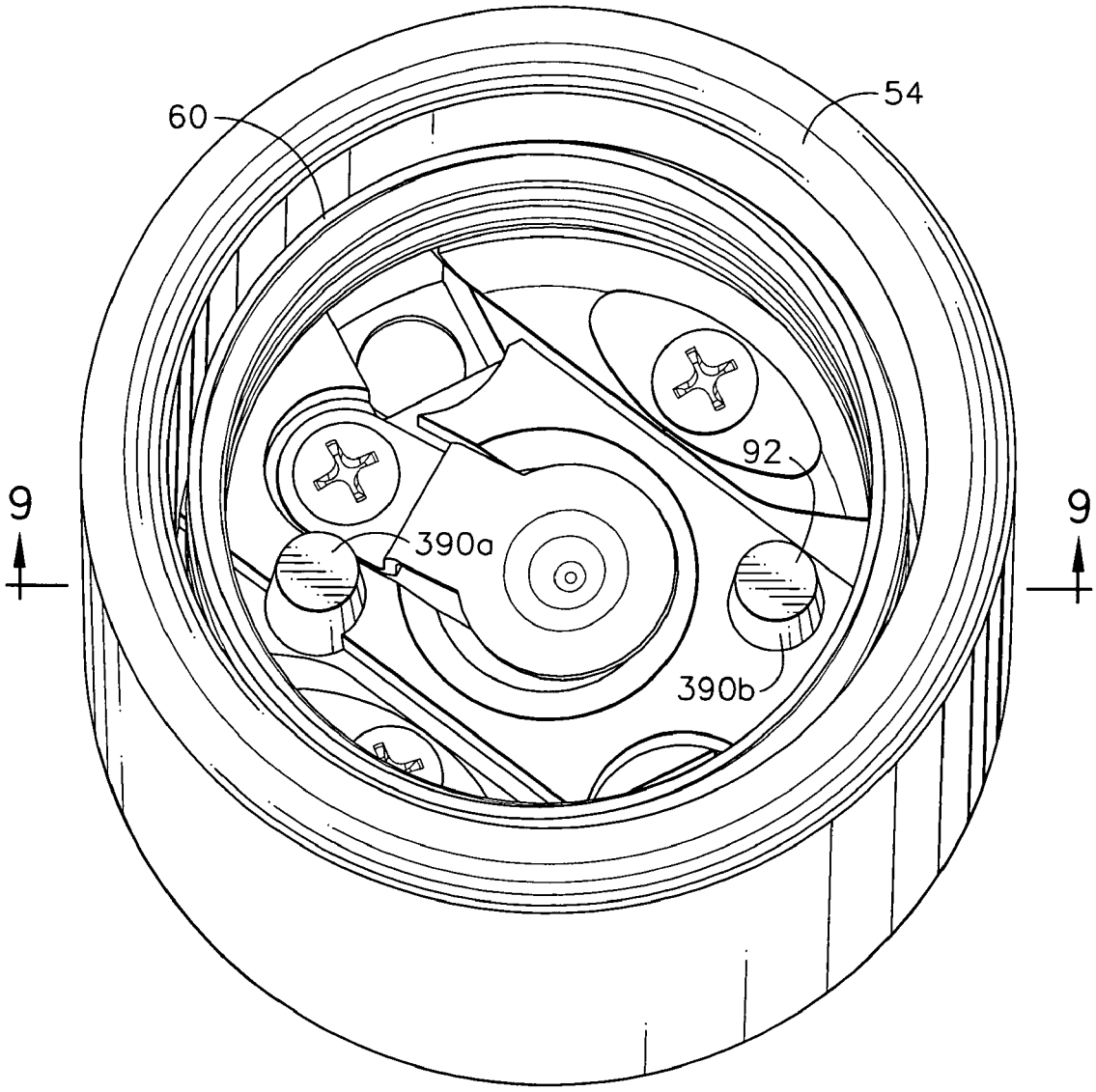
FIG. 8 is a perspective view of still another embodiment of a lampsocket having a plurality of discrete insulating spacers.
Figure 9:
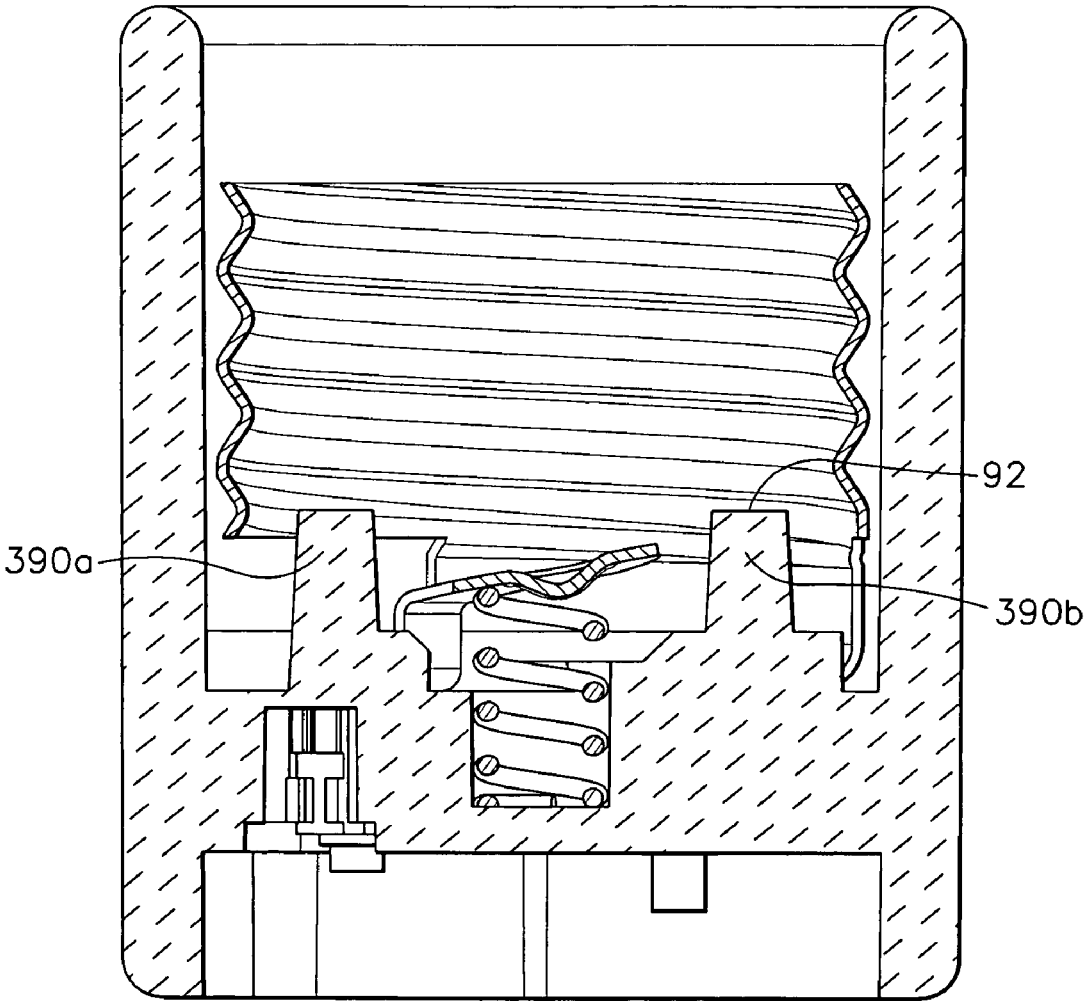
FIG. 9 is a cross-sectional view of the lampsocket of FIG. 7 through line 8—8.
Figure 10:
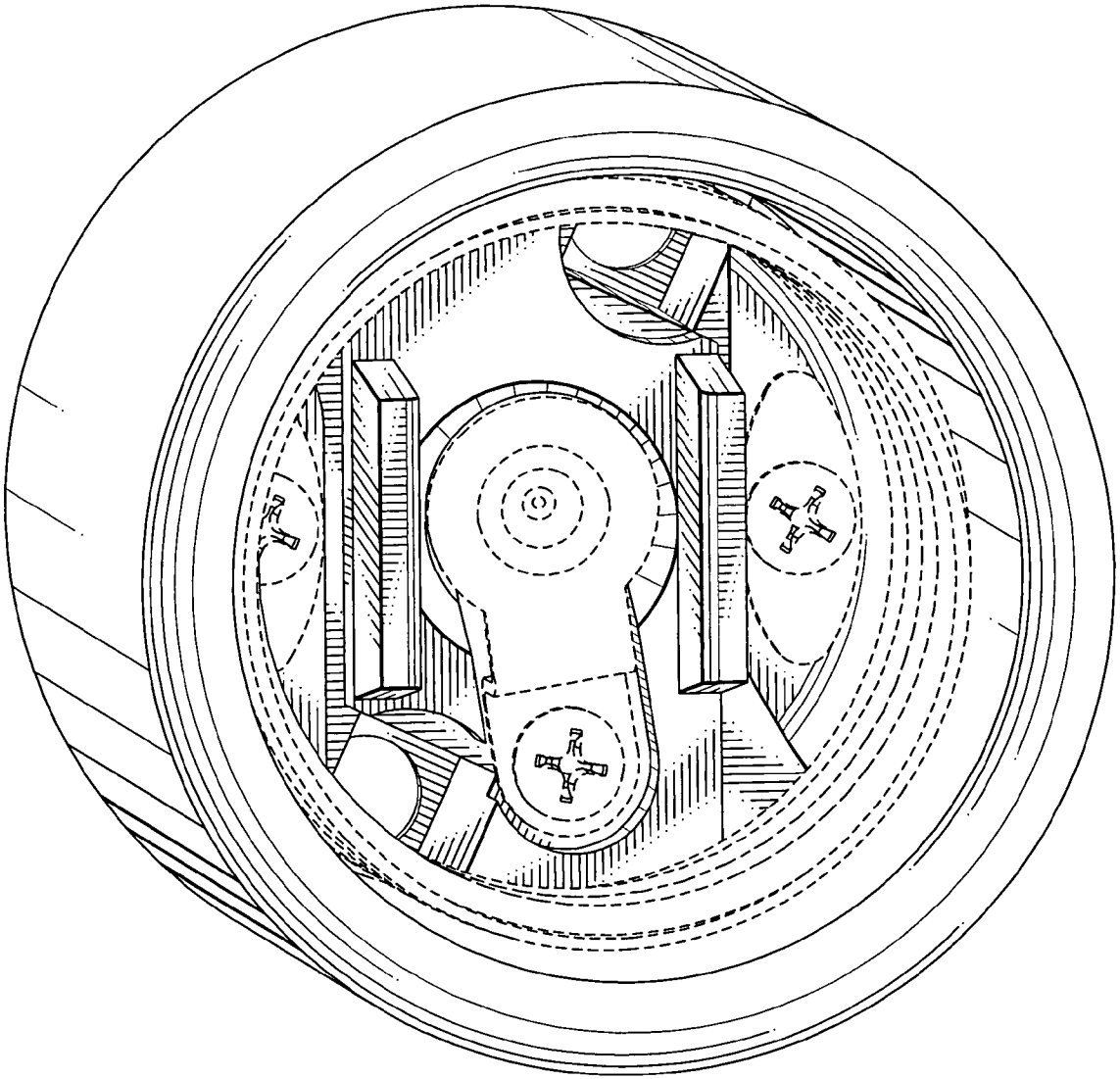
FIG. 10 is a perspective view of an embodiment of a lampsocket body with base having longitudinal spacers.
Figure 11:
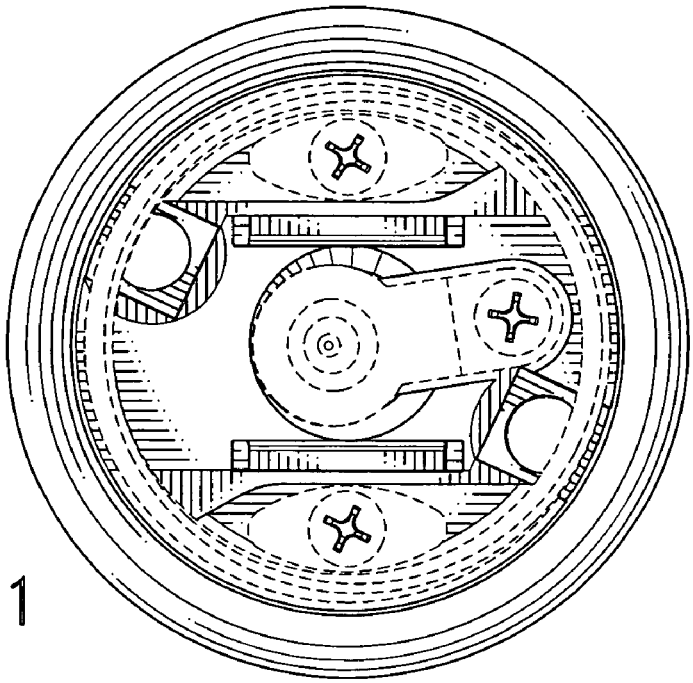
FIG. 11 is a top view of the lampsocket body with base of FIG. 9.
Figure 12:
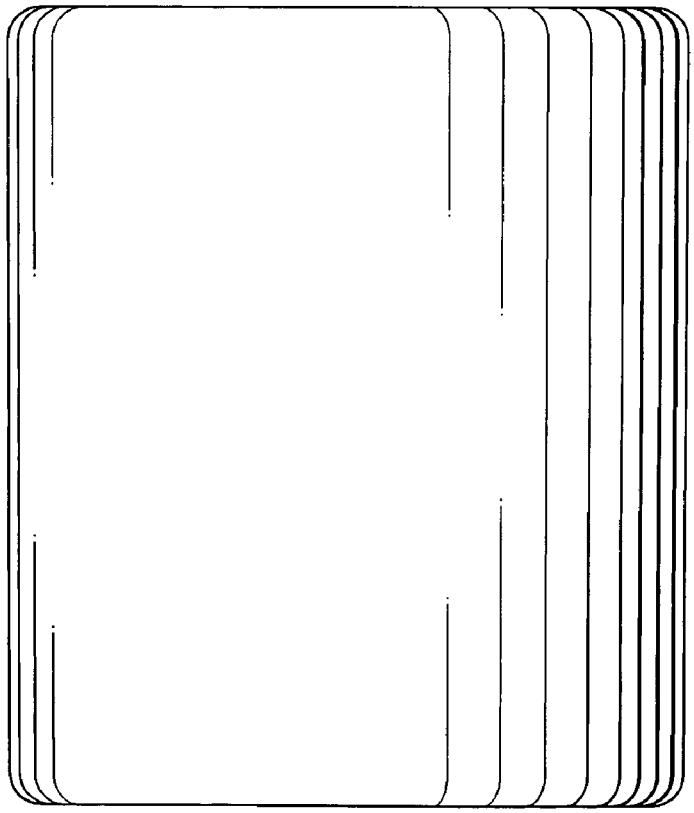
FIG. 12 is a side view of the lampsocket body with base of FIG. 9 (and is the other side, front and rear view as well).
Figure 13:
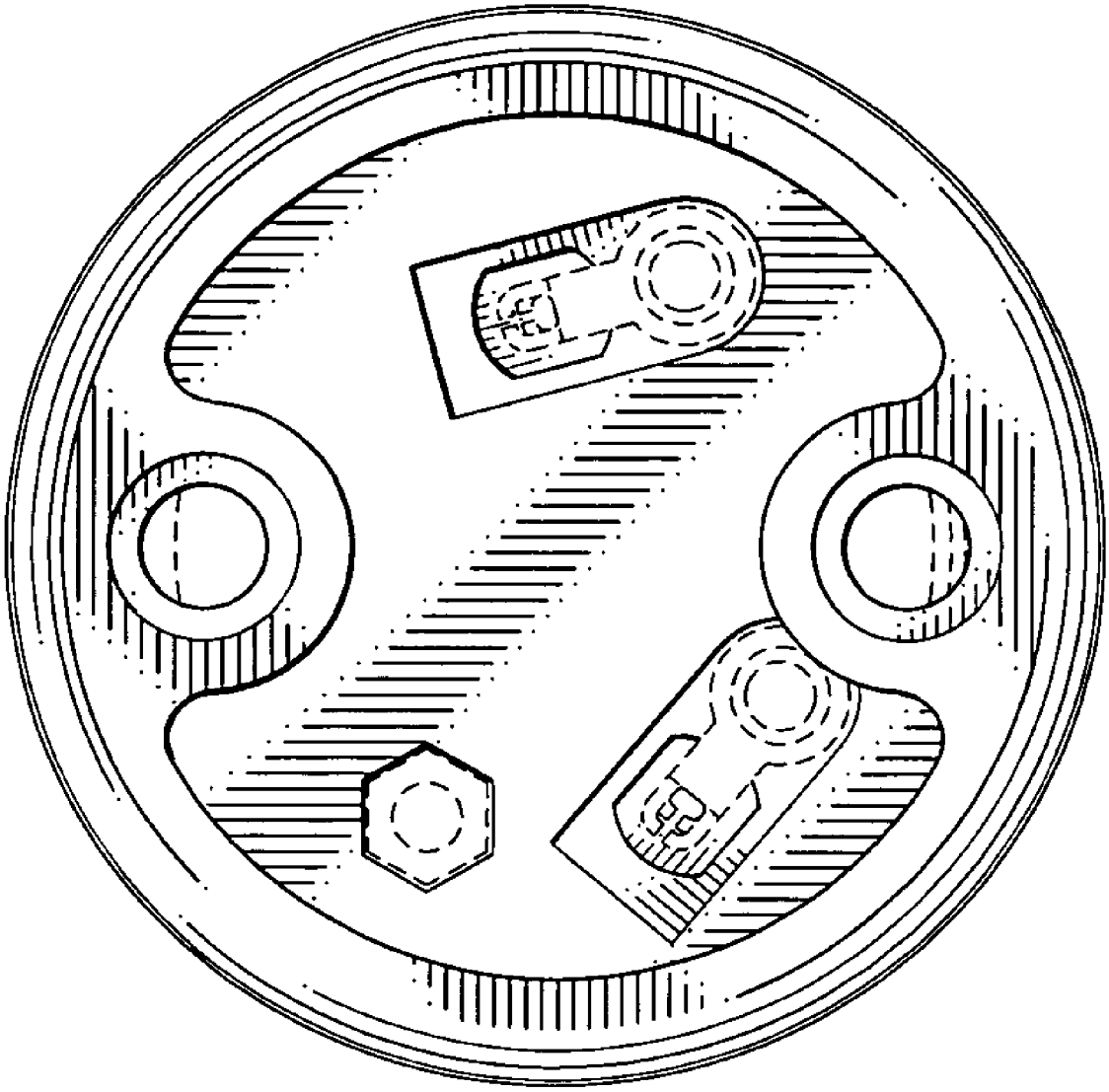
FIG. 13 is a bottom view of the lampsocket body with base of FIG. 9.
Figure 14:
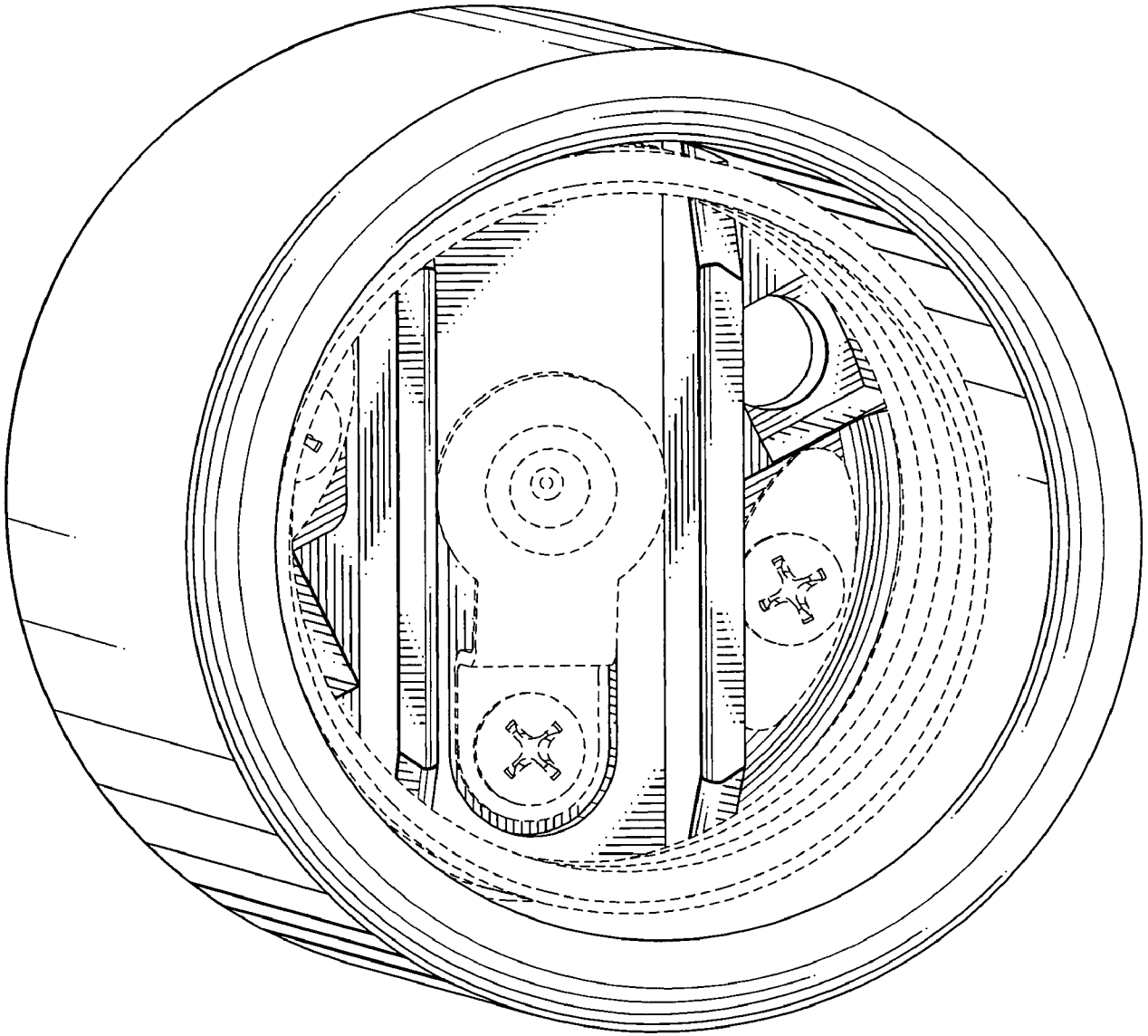
FIG. 14 is a perspective view of an alternative embodiment of a lampsocket body with base having longitudinal spacers.
Figure 15:
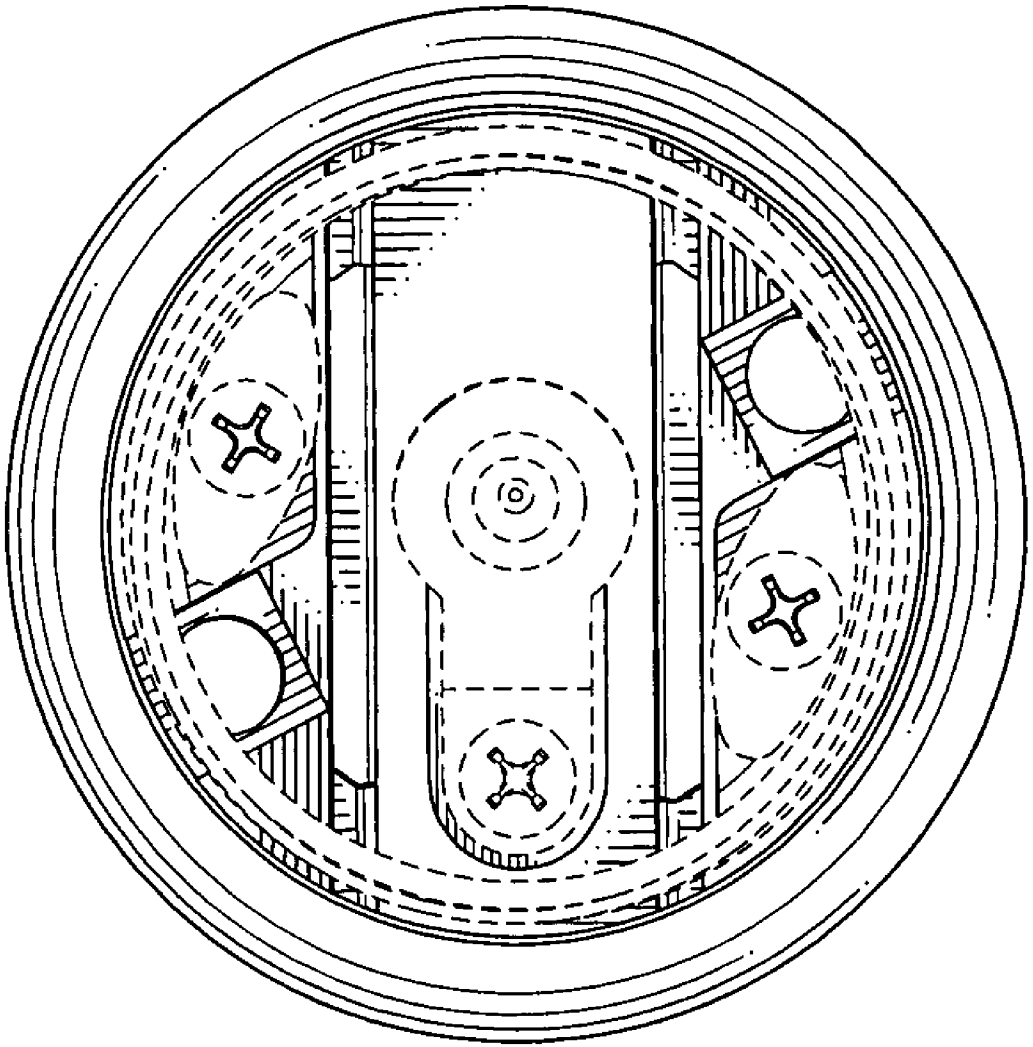
FIG. 15 is a top view of the lampsocket body with base of FIG. 13.
Figure 16:
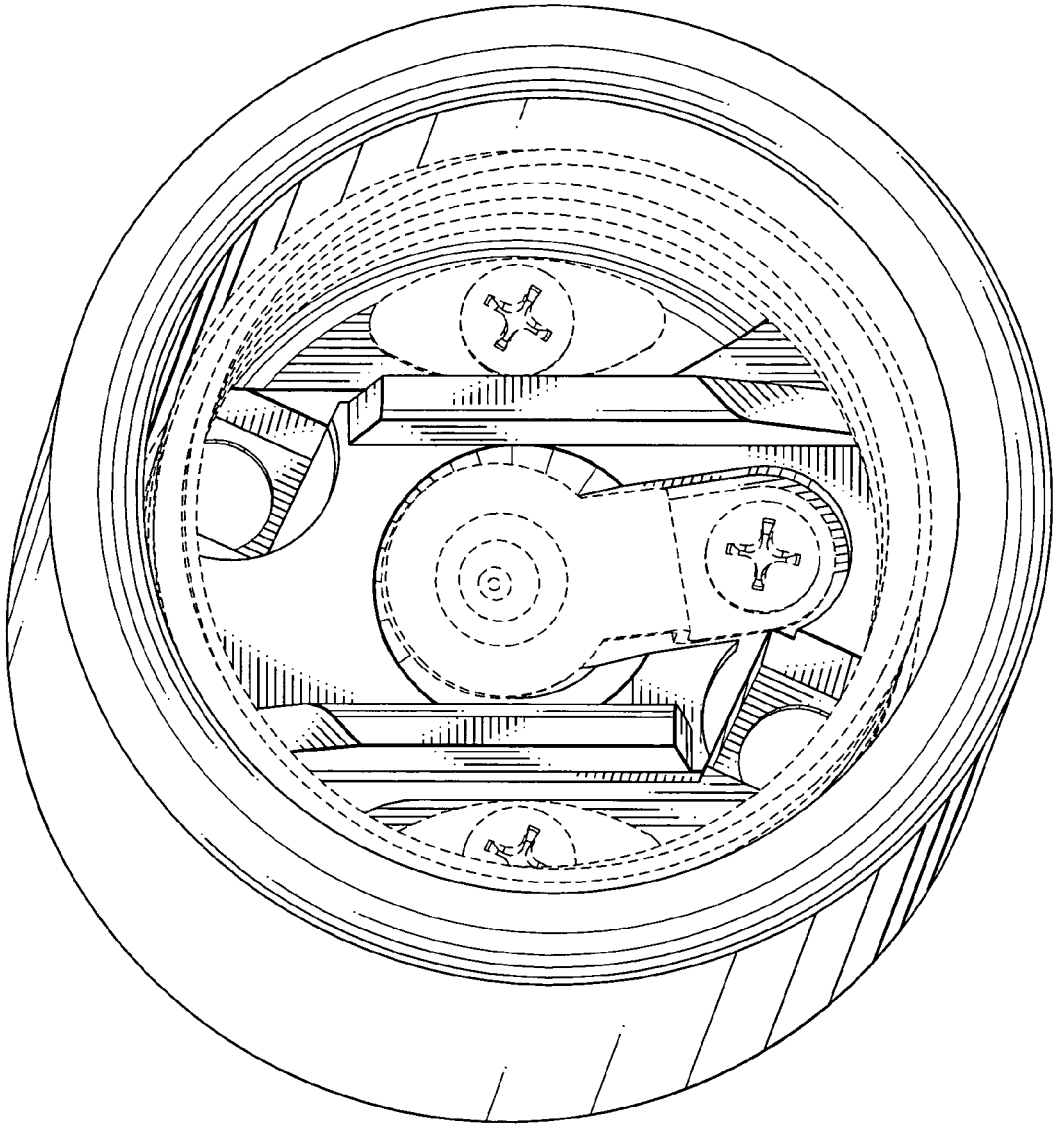
FIG. 16 is a perspective view of another alternative embodiment of a lampsocket body with base having longitudinal spacers.
Figure 17:
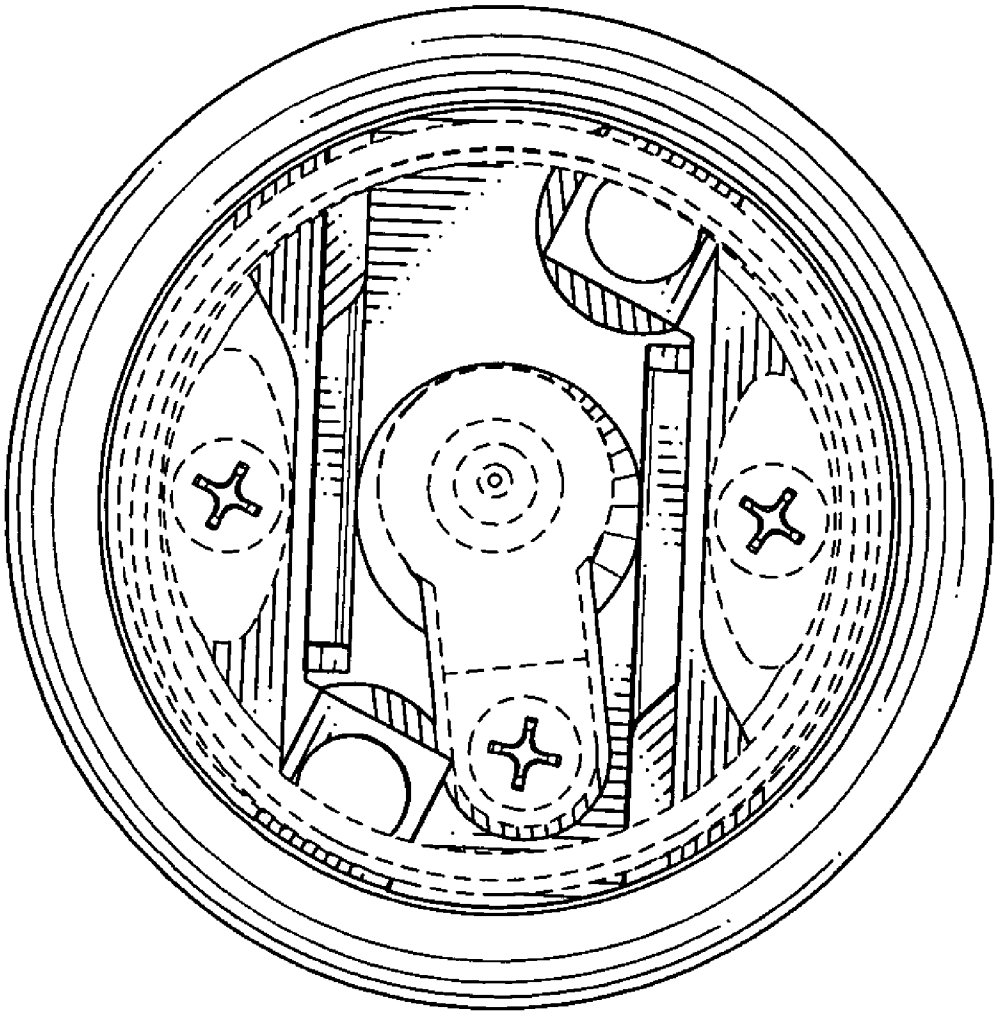
FIG. 17 is a top view of the lampsocket body with base of FIG. 15.
Figure 18:
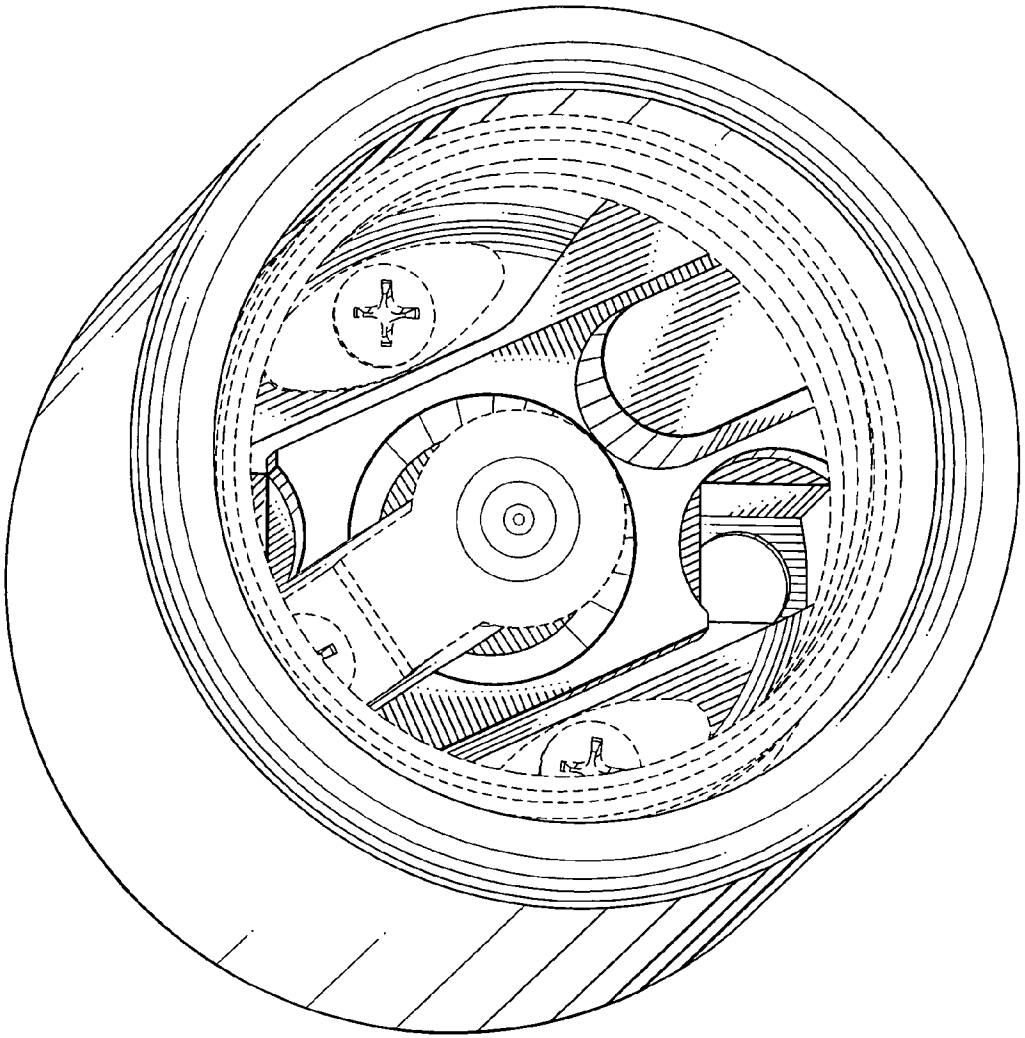
FIG. 18 is a perspective view of an embodiment of a lampsocket body with a base having an inwardly projecting spacer.
Figure 19:
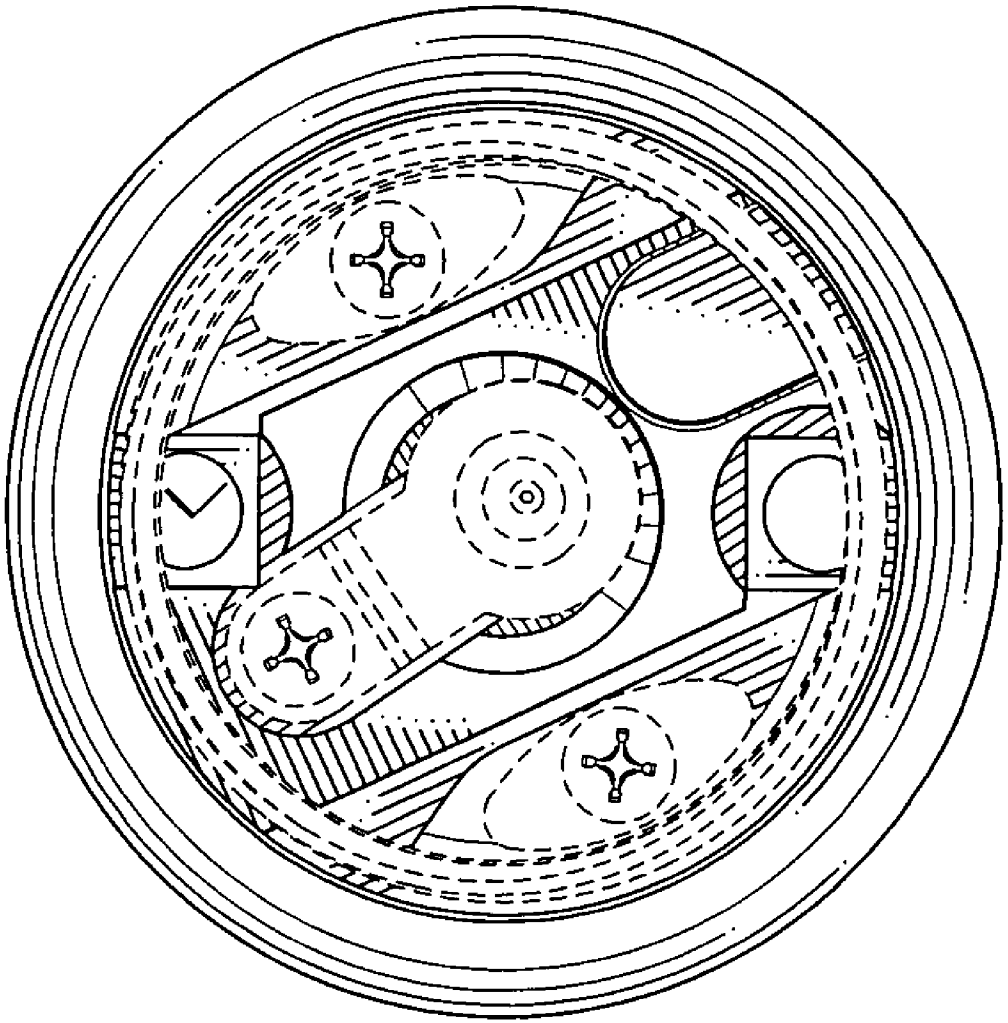
FIG. 19 is a top view of the lampsocket body with base of FIG. 17.
Figure 20:
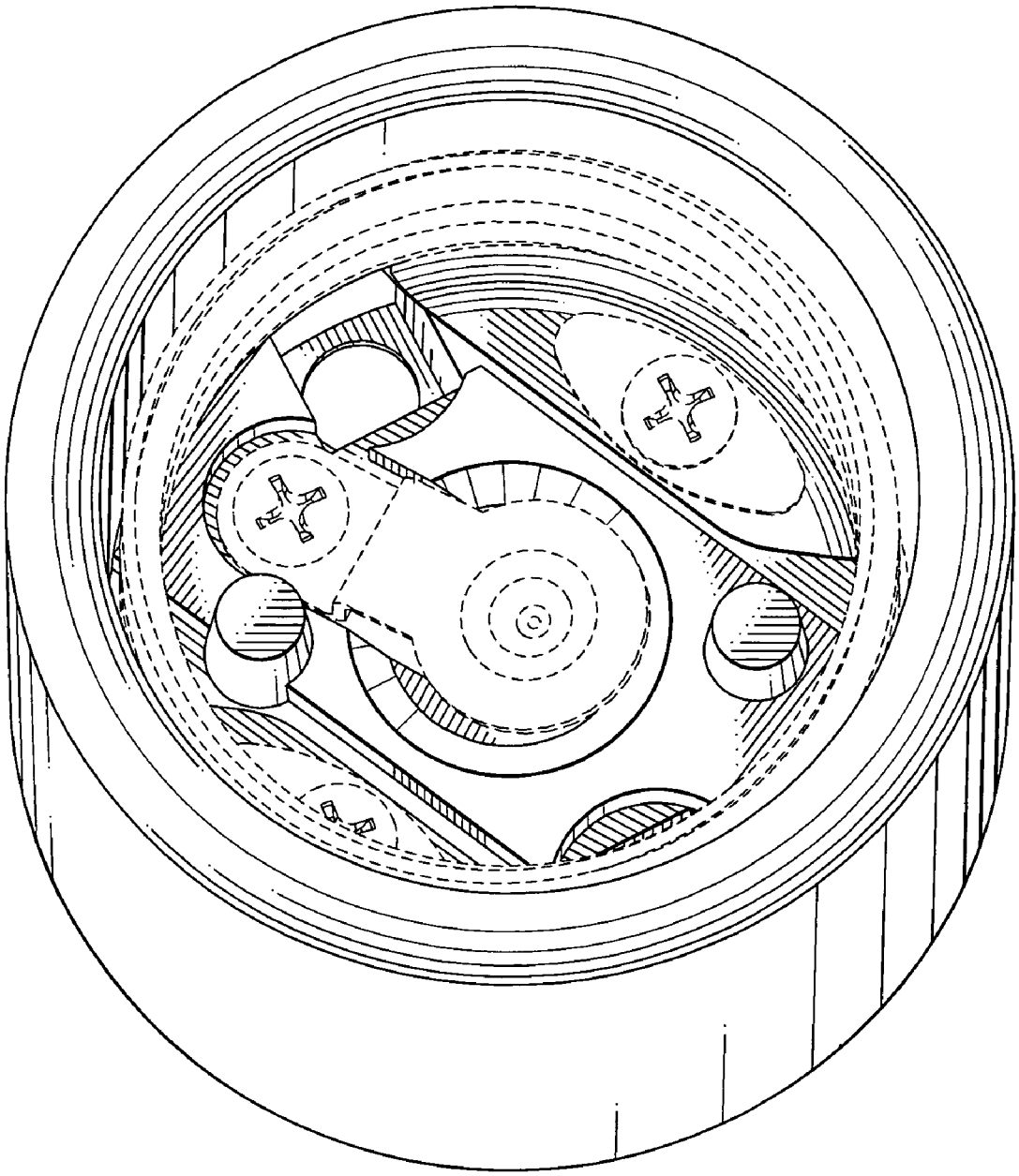
FIG. 20 is a perspective view of an embodiment of a lampsocket body with a base having a plurality of spacers.
Figure 21:
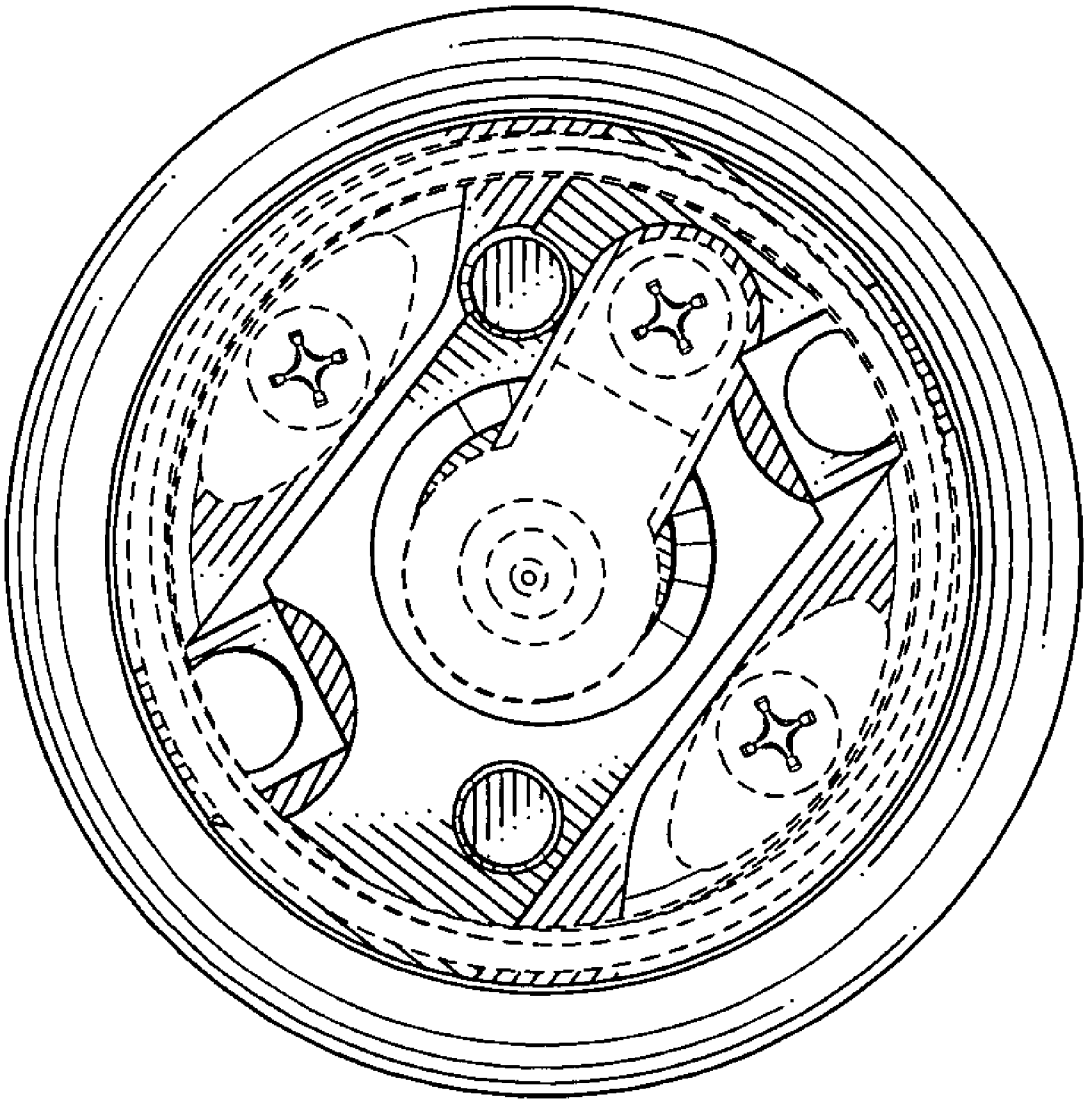
FIG. 21 is a top view of the lampsocket body with base of FIG. 19.

In still another alternative embodiment of the present invention, shown in FIGS. 8 and 9, the plurality of spacers 390 are discrete members projecting axially outward from the socket base 56, and proving separate and independent support for the flange 22 of the inserted lamp 10. Typically, at least two of the spacers 390 are positioned on opposite sides of the distal end 72 of the contact arm 70. The spacing member is typically formed integrally with the base 56 of the body. The cross-sectional size of each spacer is typically sufficient to provide a flat surface on the top 92 of the spacer. Although the illustrated embodiment shows two spacers, additional spacers can be provided.

In the embodiments of the present invention, the projecting spacers can be coated with a material or formed from a material of a color that contrasts that color of the rest of the socket base, to make the spacers apparent to a person who looks at the interior of the lampsocket, such as when selecting or purchasing the lampsocket or when determining the proper type of lamp to insert into the lampsocket.

While the present invention has been illustrated by description of embodiments that has been described in detail, to the invention as claimed in the appended claims is not restricted or in any way limited to the scope of such detail.

We claim:

1. A lampsocket for completing an electric circuit with received lamp having a threaded base having an insulated extension from the central portion of the bottom of the lamp base, and a central button mounted on the insulated extension, comprising:

a) a lampsocket body of insulating material comprising:
   (1) a peripheral wall with an open end to form a cavity within the socket body,
   (2) a base at the closed second end, and
   (3) at least two of a longitudinal rigid insulating spacer projecting axially outwardly from the base, having an upper surface disposed to engage opposite areas of the bottom of the base of the received lamp, wherein the spacers are positioned on opposite sides of the center of the base, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

2. The lampsocket according to claim 1 wherein a button contact on the base of another lamp without the insulated extension on the threaded base can not engage the contact means.

3. The lampsocket according to claim 1 wherein the opposite ends of the spacer have a taper.

4. The lampsocket according to claim 1 wherein the opposite ends of the spacer terminate inward of the metal sleeve.

5. The lampsocket according to claim 1 wherein the at least two comprises two spacers.

6. The lampsocket according to claim 5 wherein the two spacers are parallel.

7. A lampsocket for completing an electric circuit with a received lamp having a threaded base having an insulated extension from the central portion of the bottom of the lamp base, and a central button mounted on the insulated extension, comprising:

a) a lampsocket body of insulating material comprising:
   (1) a peripheral wall with an open end to form a cavity within the socket body,
   (2) a base at the closed second end, and (3) at least one rigid insulating spacer extending axially outwardly from the socket base, and having a proximate end associated with the peripheral wall, and a distal end projecting inwardly, and having an upper surface disposed to engage the bottom of the base of the received lamp, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

8. The lampsocket according to claim 7 wherein a button contact on the base of another lamp without the insulated extension on the threaded base can not engage the contact means.

9. The lampsocket according to claim 7 wherein the lampsocket body comprises a plurality of the rigid spacers.

10. The lampsocket according to claim 9 wherein at least two of the plurality of rigid spacer members are disposed with the distal ends positioned on opposite sides of the centerpoint of the base, to engage opposite areas of the bottom of the base of the lamp.

11. A lampsocket for completing an electric circuit with a received lamp having a threaded base having an insulated extension from the central portion of the bottom of the lamp base, and a central button mounted on the insulated extension, comprising:

a) a lampsocket body of insulating material comprising:

(1) a peripheral wall with an open end to form a cavity within the socket body, (2) a base at the closed second end, and (3) at least two of a rigid spacer, each extending axially outwardly from the base, and having an upper surface disposed to engage the bottom of the base of the received lamp, b) a metal sleeve configured with threads disposed on the inner surface of the peripheral wall to receive the threaded lamp base, and adapted to be connected electrically to one side of an AC voltage supply, and c) a contact means disposed at the socket base, adapted to be connected electrically to the second side of the AC voltage supply, and configured to engage the button when a lamp of the class is threadedly received into the metal sleeve.

12. The lampsocket according to claim 11 wherein a button contact on the base of another lamp without the insulated extension on the threaded base can not engage the contact means.

13. The lampsocket according to claim 11 wherein where at least two of the spacers are positioned on opposite sides of the center of the base.

* * * * *